United States Patent [19]

Hisajima et al.

[11] Patent Number: 4,673,283

[45] Date of Patent: Jun. 16, 1987

[54] COPYING MACHINE

[75] Inventors: Masahiko Hisajima, Ikoma; Yutaka Shigemura, Takarazuka; Yoshinori Makiura, Tondabayashi; Mitsuya Ishito, Sakai, all of Japan

[73] Assignee: Mita Industrial Co. Ltd., Osaka, Japan

[21] Appl. No.: 716,430

[22] Filed: Mar. 27, 1985

[30] Foreign Application Priority Data

Mar. 30, 1984 [JP] Japan ..... 59-64986

[51] Int. Cl.[4] ..... G03G 15/00

[52] U.S. Cl. ..... 355/14 SH; 355/8; 355/14 R; 355/3 SH; 355/14 FU

[58] Field of Search ..... 355/14 SH, 3 SH, 14 R, 355/14 C, 14 FU, 3 FU, 8; 219/216

[56] References Cited

U.S. PATENT DOCUMENTS 4,372,676 2/1983 Miyata et al. ..... 355/14 C 4,420,246 12/1983 Nonaka et al. ..... 355/8 X

FOREIGN PATENT DOCUMENTS 0147654 11/1980 Japan ..... 355/14 FU

*Primary Examiner*—A. C. Prescott

*Assistant Examiner*—C. Romano

*Attorney, Agent, or Firm*—Beveridge, DeGrandi & Weilacher

[57] ABSTRACT

A copying machine which develops an electrostatic latent image corresponding to an original image into a toner image, transfers the toner image on the copying paper and fuses the toner image later on the copying paper by means of a heating and fusing device, detects types of copying papers to be transferred by the toner image and when the copying paper is large in size, a fixed standstill time is arranged between the scanning and exposing operation of an original and a restoring operation to a home position is made and a fusing operation is prevented without fail when a temperature of the heating and fusing device drops below a fusing temperature.

5 Claims, 6 Drawing Figures

COPYING MACHINE

SPECIFICATION

BACKGROUND OF THE INVENTION

The present invention relates to a copying machine, more particularly, to a copying machine which heats and fuses a toner image by a heating and fusing device after transferring the toner image corresponding to an original image on the copying paper.

The copying machine of a type which forms an electrostatic latent image by scanning and exposing an original, develops the toner image and transfers thereof on the copying paper and fuses the toner image by the heating thereafter has been widely used hitherto.

In the copying machine of such type, speeding of the copying operation has been strongly requested, and recently there are provided a copying machine which has succeeded in equal size copying of the A-4 size original (210 mm×297 mm) at 40 sheets per minute or 25 sheets per minute for equal size copying of the A-3 size (297 mm×420 mm), which is considered to be a limit for the moving speed of an optical system. In such high speed copying machine, since equal size copying speed of the A-3 size original is 25 sheets per minute, 50 sheets can be copied per minute for reducing it to the A-4 size. Accordingly a capacity large enough to heat and fuse 50 sheets per minute is required as the fusing device, and a large electric current has to be supplied to the heating source in the fusing device. Further, when copying in a reduced size, since the scanning and exposing speed of the original is increased and, normally, the copying papers are fed longitudinally (from in a longer side), the capacity to heat and fuse more than 40 sheets per minute is required as the capacity for the fusing device when changed-over to the lateral feeding (from a shorter side) of the A-4 size, which inevitably needs a larger current to the heating source of the fusing device. However, since the plug socket for the usual home use has a small capacity, there may be a problem that if the required current for the copying machine is large, the use of a copying machine at home in general becomes difficult, or for making it possible to use in the general homes, the electricity to be supplied to the heat source of the fusing device must be suppressed and the copying speed has to be reduced to the copying sheets quantitatively corresponding to the capacity of the fusing device.

SUMMARY OF THE INVENTION

It is an object of the present invention to maintain a high copying speed when using the copying papers of relatively small size which is usually the case when a copying machine is used most frequently.

It is another object of the present invention to restrict lowering of the copying speed when using the copying papers of large size which has relatively a low copying frequency.

It is a further object of the present invention to accomplish the above-mentioned objects in a state in which the required electricity of a copying machine as a whole is suppressed to a low level.

The present invention constitutes a copying machine which develops an electrostatic latent image corresponding to an original image into a toner image, transfers the toner image on the copying paper and fuses the toner image on the copying paper and fuses the toner image on the copying paper later by a heating and fusing device, and is provided with a detection means for detecting the types of copying papers, a setting means for a standstill time which arranges a fixed standstill time between scanning and exposing operations of an original and a restoring operation to a home position and, further, a controlling means for operating the setting means for the standstill time by a detecting signal showing that the copying paper being large in size as an input.

BRIEF DESCRIPTION OF THE PREFERRED EMBODIMENTS

Figure 1:
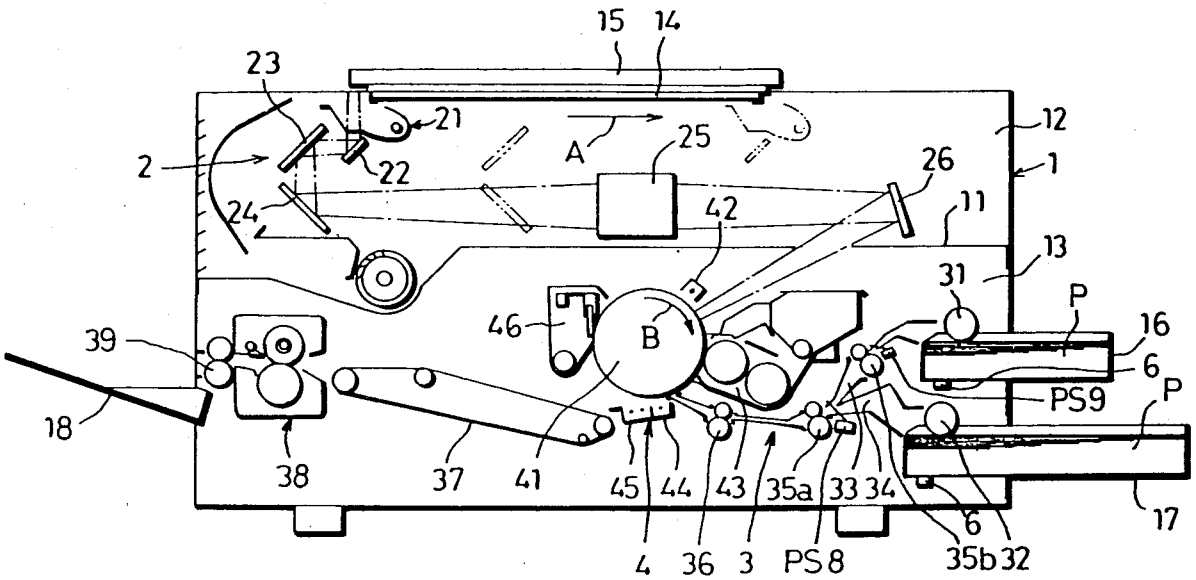
FIG. 1 is a schematic view showing internal structure of a copying machine.

FIG. 1 is a schematic view showing internal structure of a copying machine.

An inside of a copying machine body (1) is divided into an upper chamber (12) and a lower chamber (13) by a partition (11), wherein an optical system (2) for scanning and exposing an original is disposed in the upper chamber (12) and a conveying section (3) for the copying papers, a copy treatment section (4) which forms a copied image on the copying paper (P) and a detection means (6) which detects types of the copying paper (P) are provided in the lower chamber (13).

Now, the optical system (2) comprises a light source (21) having a light emitting unit and a concave reflector, plane reflectors (22) (23) (24), a lens (25) and a plane reflector (26) and is constituted in such a way that an original on a contact glass (14) can be scanned and exposed by moving the light source (21) and the plane reflectors (22) (23) (24) in a direction shown by the arrow A. However, a moving speed of the plane reflectors (23) (24) is set at half of that of the light source (21) and plane reflector (22), but, the configuration is not limited thereto, and the optical system having other configurations well known hitherto may be employed.

Further, the conveying section (3) for the copying paper comprises feed rollers (31) (32), feeding paths (33) (34), resist rollers (35*a*) (35*b*), switches (PS8), (PS9) for detecting the copying paper (P) and arranged at the upstream sides of the resist rollers (35*a*) (35*b*), a conveying roller (36), a conveying belt (37), a heating and fusing device (38) and a delivery roller (39) and is constituted in such a way that, by selectively driving either of the feed rollers the copying paper (P) will be fed one by one from either of the paper cassettes (16) or (17) to the copy treatment section (4), wherein a toner image is transferred, and delivered onto a tray (18) after the toner image thereon being heated and fused by the heating and fusing device (38), however, the configuration is not limited thereto, the conveying section for the copying paper having other configuration well known hitherto, for example, having the feeding and delivering sides of the copying paper on the same side, may be employed.

Furthermore, the copy treatment section (4) comprises an corona charger (42), a developing means (43), a transfer charger (44), a separation charger (45) and a cleaner (46) arranged in that order in the peripheral of a photoreceptor drum (41) which rotates in a direction shown by the arrow B in the drawing, and constituted in such a way that after an electrostatic latent image corresponding to the original being formed on the photoreceptor layer of the photoreceptor drum (41) uniformly charged by the corona charger (42), the electrostatic latent image will be developed into the toner image by the developing means (43) and transferred the toner image onto the copying paper (P) by the transfer charger (44) and the remained toner will be recovered by the cleaner (46). The configuration is not limited thereto and the copy treatment section having other configurations well known hitherto, for example, using a belt type photoreceptor and so on, may be employed.

Moreover, the detection means (6) are provided with a plurality of lead switches in the inner parts of the spaces inserting the paper cassettes (16) (17) of the body (1) and the magnets for operating the lead switches fixed at the tip positions on each paper cassettes (16) (17). The configuration is not limited to this, however, with the paper cassette driving the microswitch directly, for instance, may be employed.

Figure 2:
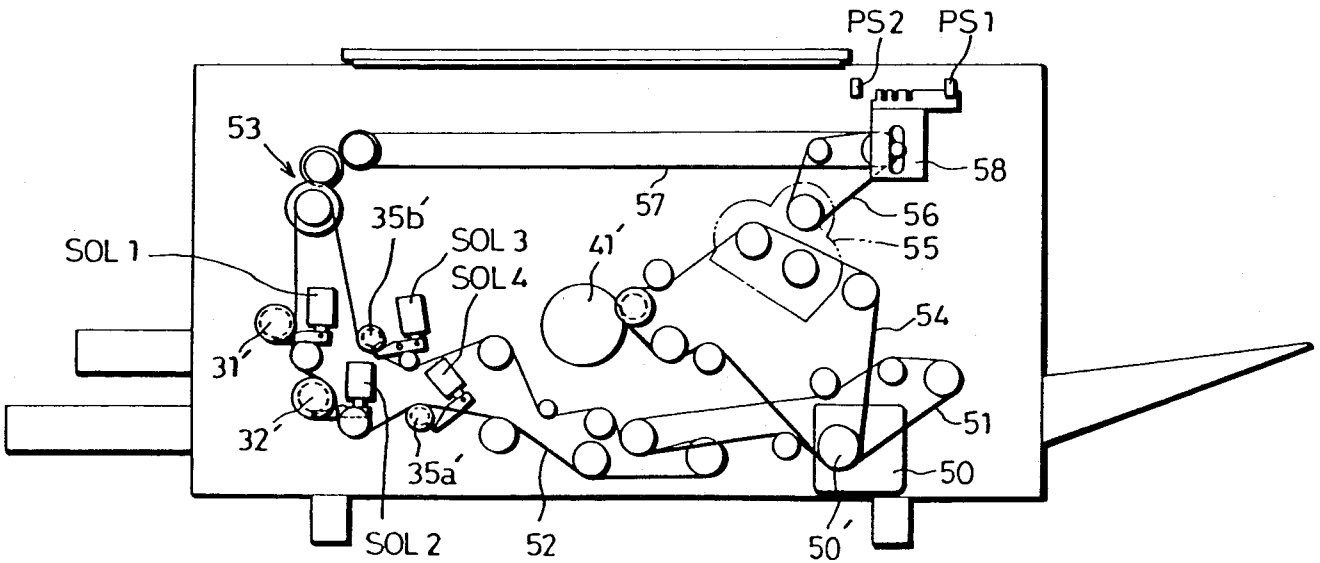
FIG. 2 is a schematic view showing a transmitting route of a driving force.

FIG. 2 is a schematic view showing a transmitting route of a driving force, wherein a No. 1 copying paper feed chain (51) and a drum chain (54) are engaged with a double sprocket (50') of a main motor (50) and No. 2 copying paper feed chain (52) is provided which moves following the No. 1 feed chain (51). The No. 2 feed chain (52) engages a return clutch (53) and the feed rollers (31) (32) and the resist rollers (35*a*) (35*b*) via spring clutches (31') (32') (35*a*') (35*b*') and solenoids (SOL 1) (SOL 2) (SOL3) (SOL 4) for operating each spring clutches (31') (32') (35*a*') and (35*b*') mentioned above are provided.

The drum chain (54) engages a photoreceptor drum sprocket (41') and a clutch (55) for scanning and exposing, which engages a exposure chain (57) via a clutch chain (56).

The light source (21) and the plane reflector (22) (Ref. to FIG. 1) are mounted on a mirror driving arm (58) which engages the exposure chain (57), and the switches (PS1) (PS2) are disposed with a fixed space therebetween in a moving direction of the mirror driving arm (58) in such a manner that, by operating the switch (PS1), whether an optical section (2') (hereinafter used as a concept representing the light source (21) and plane reflectors (22) (23) (24), is at the home position or not will be detected and by operating the switch (PS2) a timing for feeding the paper will be detected.

Figure 3:
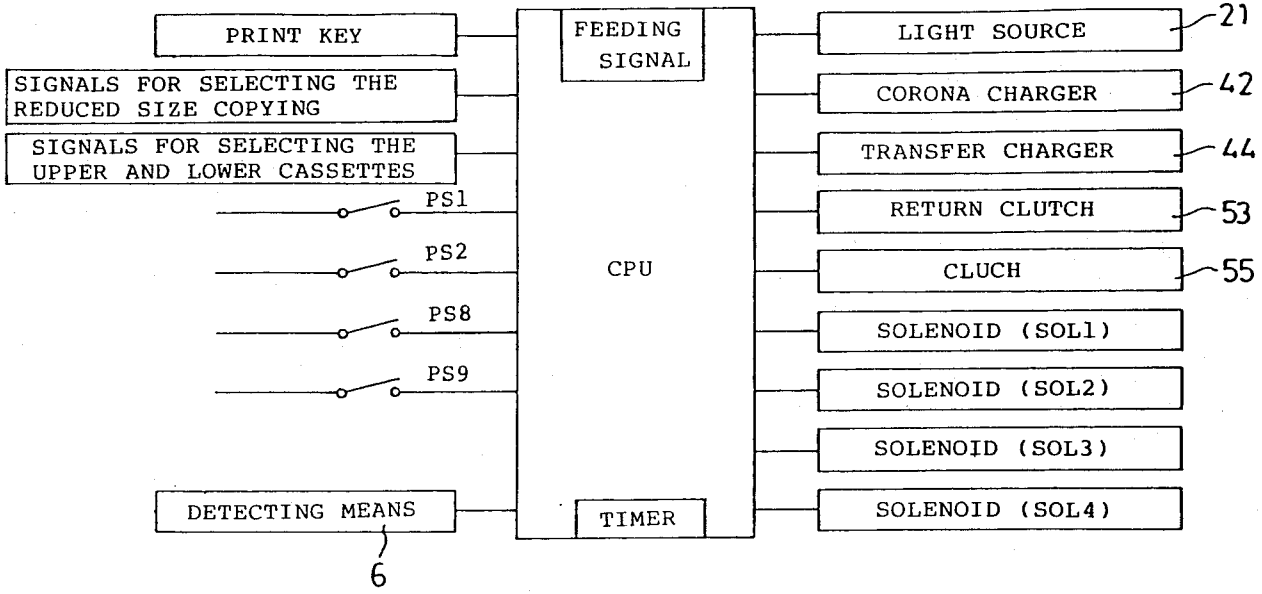
FIG. 3 is a block diagram.

FIG. 3 is a block diagram, in which an input signal for the print key, signals for selecting the reduced size copying and signals for selecting the upper and lower cassettes, switch signals (PS1) (PS2) (PS8) (PS9) and a detecting signals of a detecting means (6) are impressed in a microcomputer (CPU) as the input signals and the output signals therefrom operate the light source (21), the corona charger (42), the transfer charger (44), the return clutch (53), the clutch (55) and solenoids (SOL1) (SOL2) (SOL3) and (SOL4). Moreover, the microcomputer (CPU) includes a feeding signal for indicating the copying operation to be performed and a timer for controlling the operations of each sections.

Figures 1, 4:
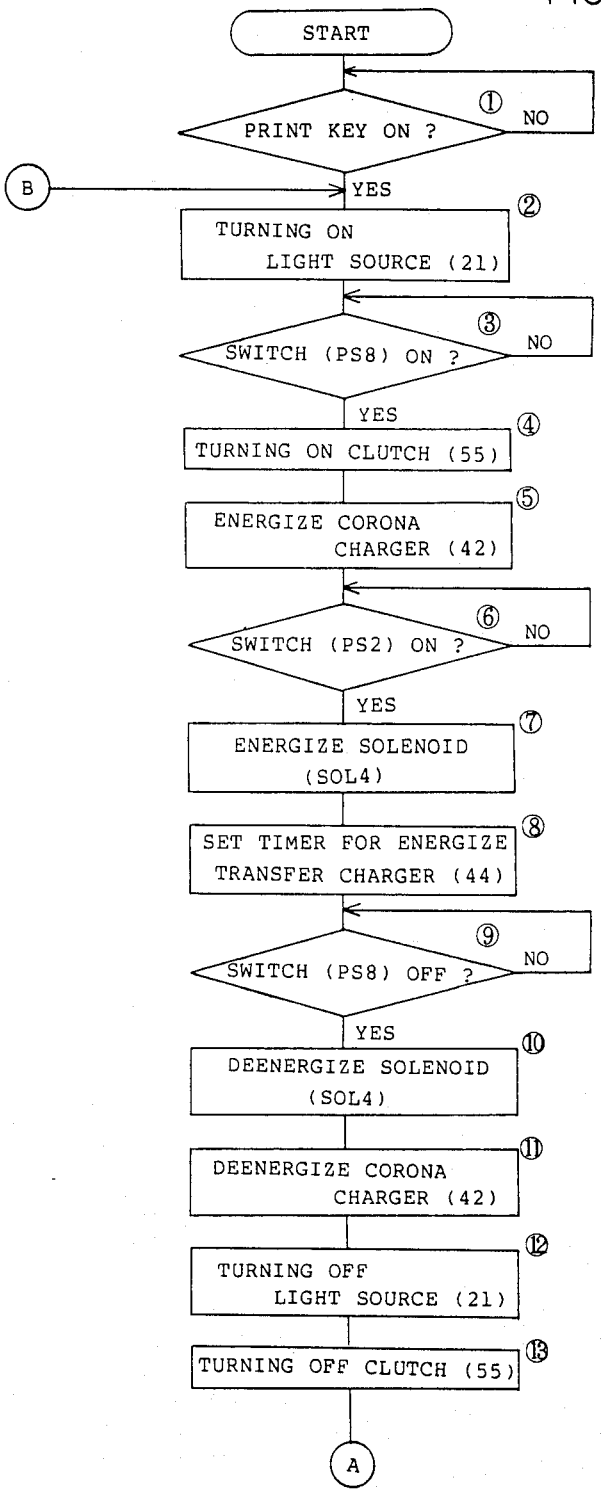
FIGS. 4 and 5 are flow charts showing the operations respectively.
Figures 2, 4:
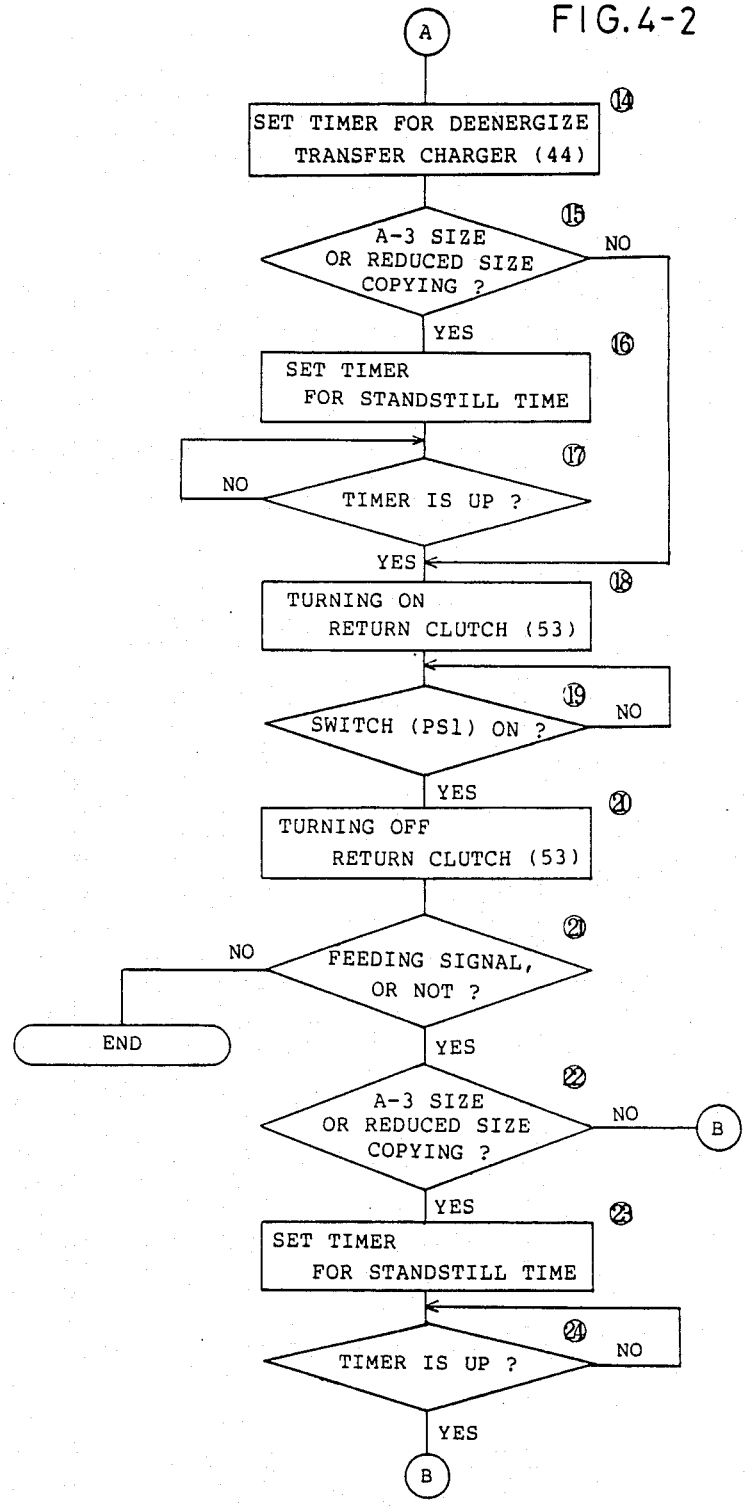

An operation of the copying machine which is constituted as mentioned above will be described with reference to FIGS. 4 and 5 as follows, FIG. 4 is a flow chart showing a total operation of the copying machine.

When the power is switched on, the copying machine keeps waiting for the print key (not shown) mounted on an operation panel of the machine to be turned on as step (1). When on, the light source (21) is lit as step (2), it waits till the copying paper (P) is fed to the resist roller (35*a*) and the switch (PS8) to be turned on as step (3), (that is, till the primary feeding is completed). When the switch (PS8) is on, the optical section (2') is operated by turning on the clutch (55) as step (4), energizing the corona charger (42) as step (5), and the timing (timing for feeding the paper) of the switch (PS2) to be turned on as step (6) is awaited. Upon the switch (PS2) being on, the resister roller (35*a*) is put into action and the secondary feeding is started by operating the solenoid (SOL 4) as step (7), setting the time till energizing the transfer charger (44) by the timer and energizes the transfer charger (44) after the setting time thereof as step (8), waiting for the switch (PS8) to turn off, that is till the copying paper (P) passes through the resist roller (35*a*) as step (9), when the switch (PS8) is off stops the solenoid (SOL4) as step (10), deenergizing the corona charger (42) as step (11), and turning off the light source (21) as step (12), stopping the optical section (2') by turning off the clutch (55) as step (13). Setting the time till deenergizing the transfer charger (44) by the timer and the transfer charger (44) is deenergized after the setting time thereof as step (14), deciding which of the equal size copying of the A-3 size or the reduced size copying to be selected as step (15). Setting the standstill time by the timer when either of the two above is decided as step (16) and the set time is awaited as step (17). When neither of the above two is the case, then the decisions and processings at steps (16) and (17) are omitted.

Further, restoring the optical section (2') by turning on the return clutch (53) as step (18), waiting till the switch (PS1) to turn on, that is, till the optical section is restored at the home position as step (19), when the switch (PS1) is on, the optical section (2') is stopped by turning off the return clutch (53) which is the step (20). As the step (21) judgment if there is a feeding signal or not. If it is "No", the copying operation is terminated at the position. If there is a signal for feeding papers, decision is made again whether the equal size copying of the A-3 size or the reduced size copying to be selected as step (22). If the case is neither of them, then the decisions and processing from step (2) and onward are proceeded with.

On the other hand, if either of the two above is the case, setting the standstill time by the timer as step (23), and waiting the set time to elapse as step (24), the decisions and processings from step (2) onward are proceeded after the set time is finished.

Figure 5:
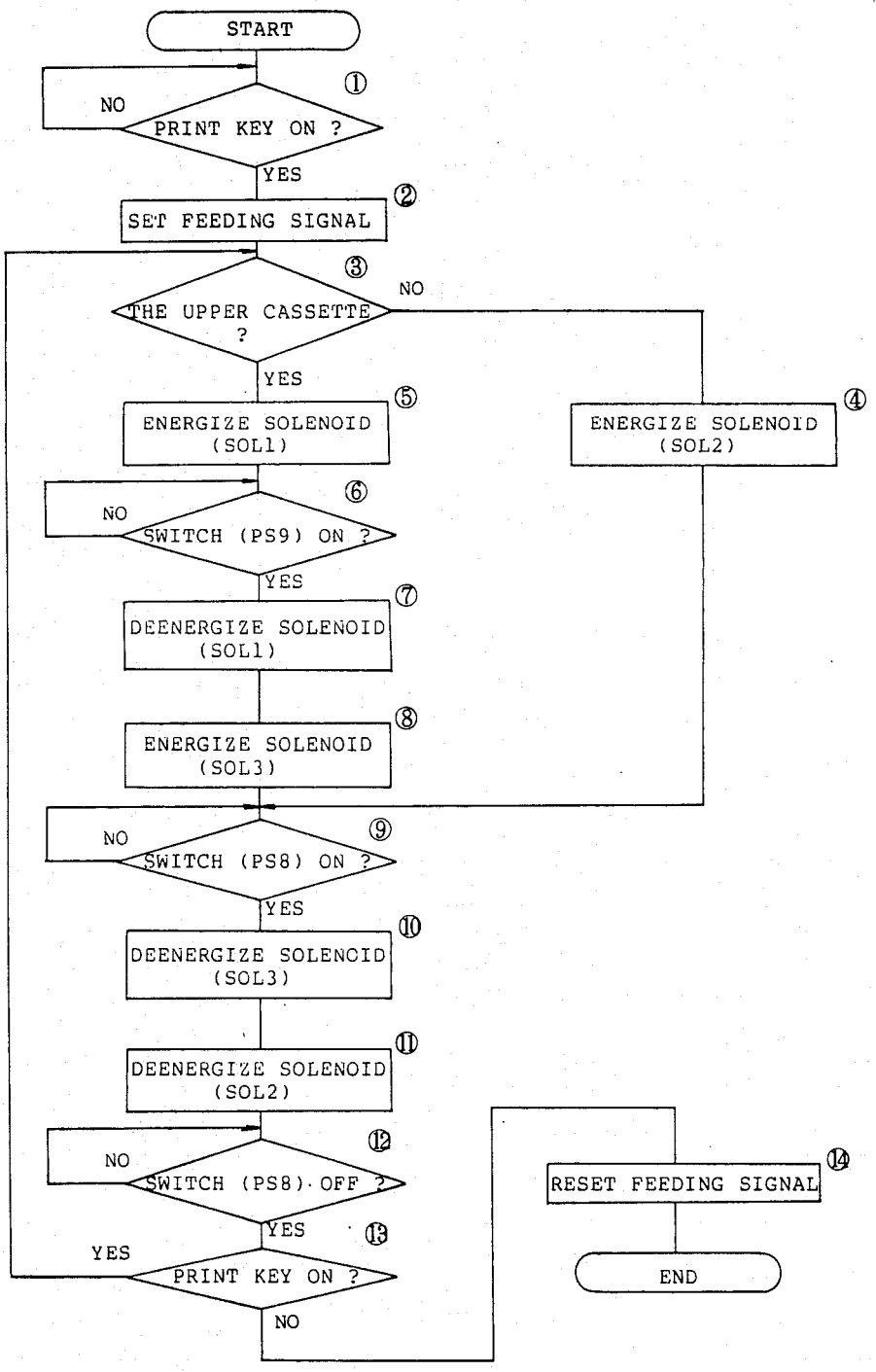

Furthermore, FIG. 5 is a flow chart showing a controlling operation for feeding the papers.

When the power is switched on, the copying machine awaits the print key to be turned on as step (1). Then upon the turning on of the print key, setting of the feeding signal is performed as step (2) and judgment is made if the upper paper cassette (16) has been selected as step (3). If the lower cassette (17) has been selected, turning on the solenoid (SOL2) for the feed-roller (32), the copying paper (P) from the paper cassette (17) is fed as step (4) and waiting the switch (PS8) to turn on, that is, till the copying paper (P) contacts the resist roller (35*a*), so called completion of the primary feeding, as step (5). On the other hand, if the upper cassette (16) has been selected, turning on the solenoid (SOL1) for the feed roller (31) and feeding the copying paper (P) from the cassette (16) as step (5). Waiting for the switch (PS9) to turn on, that is, till the copying paper (P) contacts the resist roller (35*b*) as step (6), then solenoid (SOL1) is turned off as step (7), and turning on the solenoid (SOL3) to drive the resist roller (35*b*) for feeding paper as step (8) and so called completion of primary feeding as similarly mentioned above is awaited as step (9). Thereafter, turning off the solenoid (SOL3) as step (10) and solenoid (SOL2) as step (11) and turning on the solenoid (SOL4) and starting of the secondary feeding are apparent from the flow chart shown in FIG. 4. Then, waiting for the switch (PS8) to turn off, that is, till the rear edge of the copying paper (P) is sent out from the resist roller (35*a*) as step (12), thereafter, judgment is made whether the print key is on or not, that is, a continuous copying or not as step (13). If "Yes", decisions and processings from step (3) and onward are taken in repetition. If "No", resetting the feeding signal and terminating the feeding operation as step (14).

As is clear from the above description, when the equal size copying of the A-3 size or the reduced size copyings are selected, since restoring operation is performed after a short standstill time upon the scanning and exposing to the arrow direction marked A, and the scanning and exposing is performed to the arrow direction marked A after a short standstill time upon the restoring operation, the time not necessary for the heating and fusing device for any heating and fusing of the toner image on the copying paper is secured per each fixed time even when a lot of sheets are continuously copied, thus a good heating and fusing performance may be attained without particularly increasing the capacity thereof.

On the other hand, when performing the equal size copying of the small sizes, the A-4 size for instance, the capacity of the heating and fusing device is, as mentioned above, able to well applicable for a copying speed of, for instance, 40 sheets per minute as it is without any special care.

Furthermore, the present invention is not limited to the above embodiment, but various changes and modifications in designs may be made within the scope not departing from the spirit of the invention. It is possible, for instance, to arrange a fixed standstill time only during the time starting after the heating and exposing before the starting of the restoring operation. Besides, it is also possible to arrange a fixed standstill time when copying a size larger than a fixed sizes without limiting the size to the A-4 size. Various other alterations in design are possible to be made within the scope not deviating the essence of the invention.

What is claimed is:

1. A copying machine which develops an electrostatic latent image corresponding to an original image into a toner image, transfers the toner image on a copying paper and fuses the toner image on the copying paper by a heating and fusing device, said machine comprises a detection means for detecting types of copying papers, a setting means for setting a first fixed standstill time in which an optical section halts after completing a scanning and exposing operation before beginning a restoring operation and for setting a second fixed standstill time in which the optical section halts after completing said restoring operation and before beginning a next scanning and exposing operation so as to provide a period during which the heating and fusing device is not supplied with a copying paper, and a controlling means connected from the output of the detection means and to the input of the setting means for operating the setting means for fixing said standstill times by a detection signal supplied from the detection means showing that the copying paper is large in size as an input signal.

2. A copying machine according to claim 1, which scans and exposes an original by moving an optical section.

3. A copying machine according to claim 1, wherein the detection means detects types of copying papers whether the papers are under A-4 size or not.

4. A copying machine according to claim 1, wherein said standstill times are set up uniformly in the copying machine, thereby said period during which the heating and fusing device is not supplied with a copying paper is ensured.

5. A copying machine according to claim 1, wherein the detection means further comprises a magnet mounted at a fixed position of a paper cassette and lead switches being installed at a fixed position of the copying machine and operated selectively by said magnet; said fixed position of the magnet being arranged corresponding to a size of the copying paper in the paper cassette.

* * * * *